US005513820A

United States Patent [19]

Meyer

[11] Patent Number: 5,513,820

[45] Date of Patent: May 7, 1996

[54] CORE PLUG APPARATUS

[75] Inventor: Robert A. Meyer, Yakima, Wash.

[73] Assignee: Meyer Plastics, Inc., Yakima, Wash.

[21] Appl. No.: 153,353

[22] Filed: Nov. 15, 1993

[51] Int. Cl.[6] ..... B65H 75/08; B65D 39/00; B65D 43/08

[52] U.S. Cl. ..... 242/613.5; 242/118.31; 215/355; 220/356

[58] Field of Search ..... 242/613.4, 613.5, 242/613, 118.31, 118.32; 215/355, 364; 220/352, 356

[56] References Cited

U.S. PATENT DOCUMENTS

| | | | |
|---|---|---|---|
| 3,627,220 | 12/1971 | Vogel | 242/613.5 |
| 3,627,221 | 12/1971 | Nichols et al. | 242/613.5 |
| 4,083,508 | 4/1978 | Pattillo | 242/613.4 |
| 4,372,500 | 2/1983 | Saraisky | 242/613.5 |
| 4,875,636 | 10/1989 | Kewin | 242/613.5 |
| 4,977,930 | 12/1990 | Munk et al. | 242/613.5 |

FOREIGN PATENT DOCUMENTS

| | | | |
|---|---|---|---|
| 1142649 | 9/1957 | France | 215/355 |
| 73313 | 6/1960 | France | 215/355 |
| 74179 | 11/1960 | France | 215/355 |

OTHER PUBLICATIONS 4 color photographs of a solid core plug made of compressed wood chips manufactured by Moldwood Products of York, Alabama (Date Unknown).

*Primary Examiner*—John Q. Nguyen

*Attorney, Agent, or Firm*—Wells, St. John, Roberts Gregory & Matkin

[57] ABSTRACT

A core plug apparatus includes an outer wall, an inner hub, a middle strengthening ring, and a plurality of interconnecting vanes. A vacuum seal wall covers one end of the plug to enable a vacuum lift force to be generated at one end of the roll of material. The vacuum seal wall includes a relatively thin central portion which can be displaced to allow the roll to be installed on a pair of mandrels, or to transport the roll using a rod extending from a lift device. The outer surface of the core plug may be textured to further increase frictional forces between the core plug and the inside wall of the core.

3 Claims, 4 Drawing Sheets

CORE PLUG APPARATUS

TECHNICAL FIELD

This invention relates to plugs for rolls of material, and, more particularly, to core plugs insertable into the core of a roll of material.

BACKGROUND OF THE INVENTION

Handling rolls of material, particularly large, heavy rolls of material, involves unique and substantial obstacles that must be overcome. Such large rolls of material are typically created by wrapping the particular material around a hollow core, which is rotated on a mandrel or pair of spindles.

With respect to certain types of materials, such as paper and other delicate materials, the rolls must be carefully handled to avoid damage to the material. Such rolls of material have traditionally been transported in a variety of ways to prevent direct contact with, and therefore damage to, the material. One of the most common transportation and handling methods involves inserting a rod connected to a lift device into the hollow core of the roll, and then lifting the roll with the rod. This method prevents contact with the material on the outside of the roll.

Another known method of lifting rolls without contacting the surface of the material involves creating a vacuum on one end of the roll. The vacuum force is then used to lift and transport the roll. This method of transportation and lifting allows the rolls to be stored vertically, by placing the rolls on their ends. Storing the rolls on their ends allows storage space to be used more efficiently (rolls can even be stacked on top of one another), and reduces the contact area between the lifting device and the roll.

Using a vacuum force to lift rolls of material creates a unique set of handling problems, particularly in the case of large paper rolls for newsprint. An effective and economical seal must be created at one end of the roll so that a vacuum can be produced on the opposite end for transporting the roll by means of a vacuum lift device. The device used for sealing one end of the roll should be effective, yet relatively easy to install and remove when necessary.

One known type of sealing device is a plug formed from compressed wood and glue. The outer surface of the wood plug slopes continually from a narrowed end (inserted first into the core) to a wide end. The wood plug is inserted into an end of the core to plug up the opening. The plug must overcome an interference fit with the core after it has been completely inserted to form a proper seal.

Use of wood as a core plug material has several drawbacks. Recently, the cost of wood has increased dramatically. Also, a core made of compressed wood and glue is heavy, which creates substantial additional costs in transporting the plugs. The compressed wood plugs also break down structurally when exposed to moisture.

Known compressed wood plugs either have a central aperture or are solid. A solid compressed wood core plug is difficult to remove from the core once installed. If the compressed wood plug has a central aperture for handling and installation purposes, the aperture must be plugged in order to create a vacuum on the opposite end of the roll. Attempts to suitably seal such apertures in compressed wood plugs in order to create a vacuum have heretofore been unsuccessful.

Accordingly, there is a need to develop a core plug that is insertable into the ends of a core around which material is wrapped, that will seal one end of the core to enable a vacuum lift force to be created on the opposite end for transportation purposes, that will enable the roll to be installed onto spindles of a reel without having to remove the core plugs, and that will provide sufficient axial and radial strength to support the roll through the core plugs once installed upon a pair of spindles. The present invention involves a core plug which provides substantial and surprising benefits in this regard. The various objects, features, and advantages of the invention will become apparent from the detailed disclosure that follows.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This invention disclosure is submitted in furtherance of the constitutional purposes of the U.S. Patent Laws "to promote the progress of science and useful arts." (Article 1, Section 8).

Figure 1:
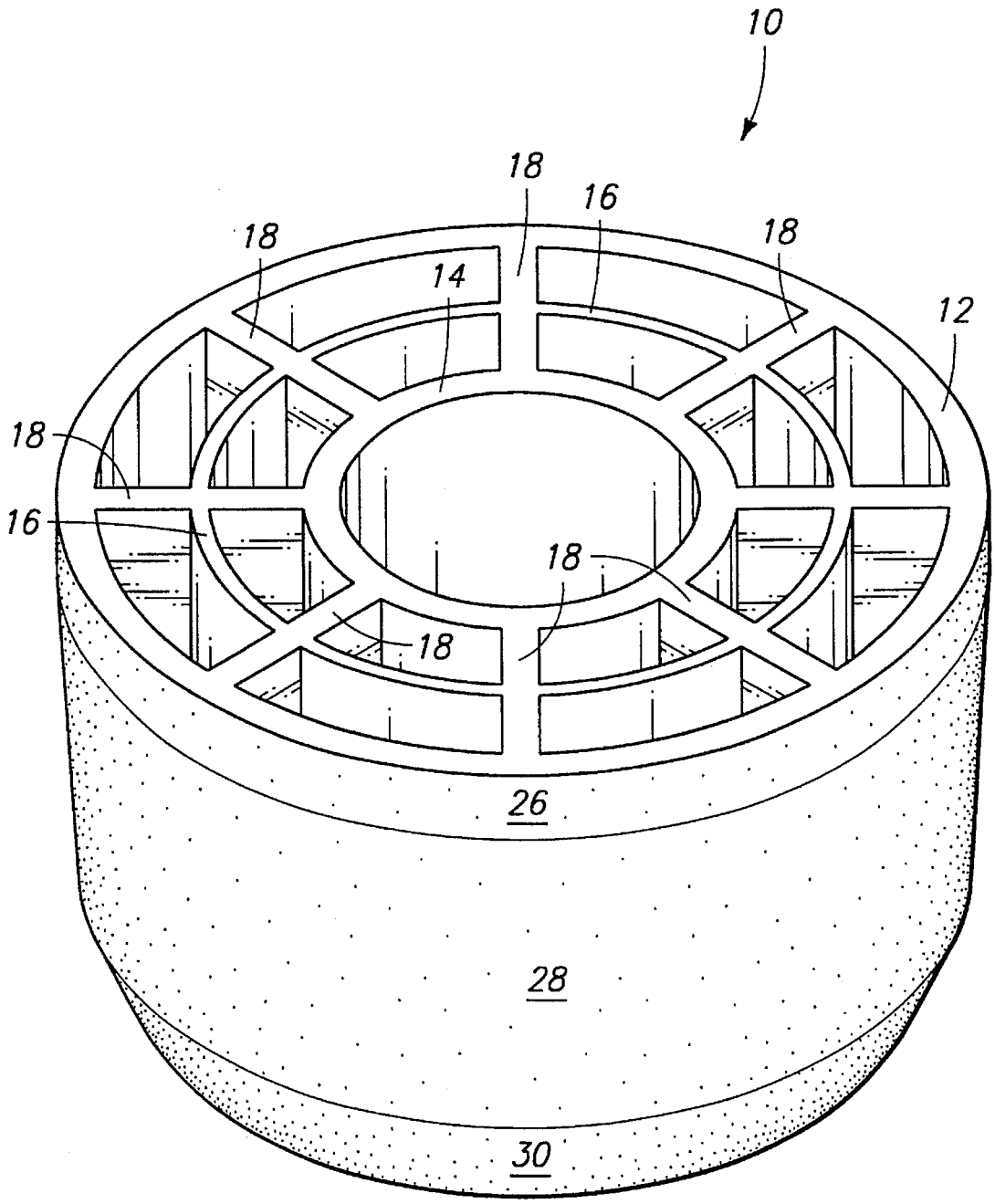
FIG. 1 is an isometric view of a core plug apparatus according to the present invention.
Figure 2:
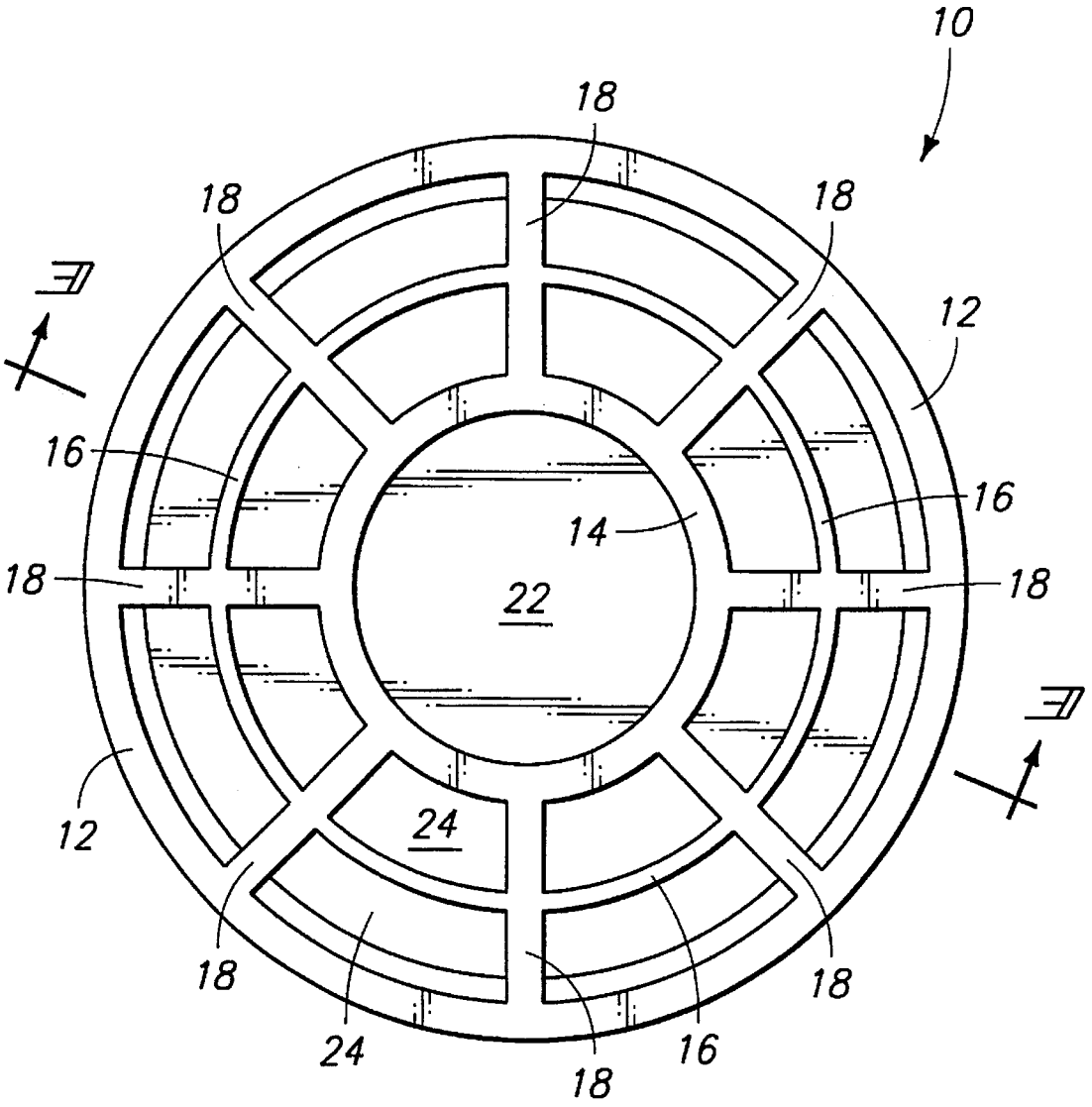
FIG. 2 is a top view of the core plug apparatus of FIG. 1.
Figure 3:
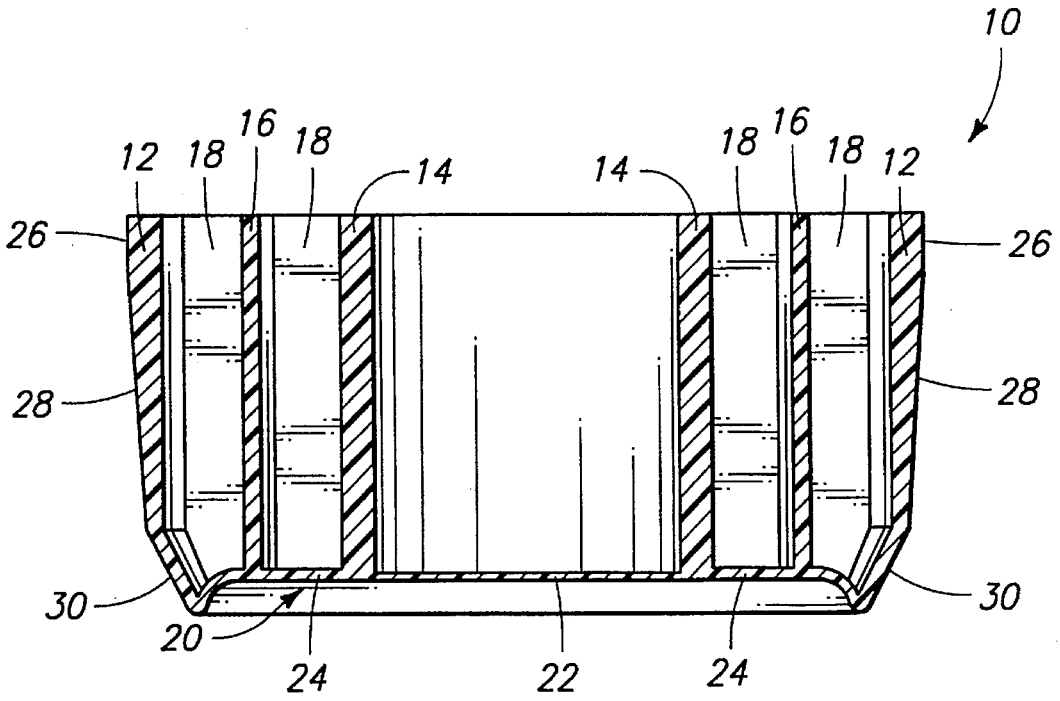
FIG. 3 is a sectional side elevation view, taken along the line 3—3 of FIG. 2.

FIGS. 1–3 show a core plug apparatus 10 for use in connection with rolls of material, such as paper rolls, having a core around which the material is wrapped. The core plug 10 comprises generally an outer wall 12, an inner hub 14, and a middle strengthening ring 16. A plurality of interconnecting vanes 18 extend integrally from the inner hub 14 and the outer wall 12. The middle ring 16 interconnects in an integral manner with each of the vanes 18. The vanes provide axial strength to the core plug so that the roll can be supported through the core plug. The middle ring substantially increases the strength of the core plug, both in an axial direction (i.e., parallel to the longitudinal axis of the core in which the plug is inserted) a radial direction (i.e., perpendicular to the axis of the core).

With reference to FIG. 3, the core plug apparatus 10 further includes a vacuum seal wall 20 formed at a proximal end of the core plug. The seal wall comprises a relatively thin central portion 22 and a relatively thick outer portion 24 which extends radially outward from the central portion 22. The central portion 22 covers an area of the proximal end of the core plug extending radially inward of the inner hub 14. The outer portion 24 covers an area of the proximal end of the core plug extending radially outward of the central portion (i.e., between the inner hub 14 and strengthening ring 16, and between the strengthening ring 16 and the outer wall 12). In one embodiment, the central portion is approximately 0.030 inches thick, whereas the outer portion is 0.100 inches thick.

The purpose of providing a relatively thin central portion 22 is to enable a rod on a forklift or some other support or handling device to displace or rupture the central portion 22 of the core plug 10 when the rod is inserted into the hub 14 with a moderate insertion force. The central portion 22 is preferably thin enough to allow complete displacement while preventing the insertion force from forcing the core plug further inside the core. With the central portion 22 displaced, the roll of material, including the core plugs 10, can be mounted on a mandrel or a pair of spindles for transportation or dispensing purposes. Alternatively, the plugs 10 can be removed from the core before mounting the roll on the spindles. Removal of the plugs is facilitated by providing access through the opening inside the inner hub 14. In the case of a single rod of a forklift, the central portion of only one of the core plugs may need to be displaced. The remaining plug (with the seal wall 20 fully in place) would enable a vacuum force to be created on the opposite end of the roll for vacuum lifting purposes.

Both ends of a core could be sealed with core plugs 10 each having respective seal walls 20, including central portions 22 and outer portions 24. As such, one or both of the respective central portions 22 could be displaced to provide an opening in the core plug 10 for mounting the roll on a lifting or dispensing device. Alternatively, the core plug at one end of the roll can remain unaltered to create a seal for vacuum lift purposes on the opposite end. In another embodiment, a core plug 10 having a full seal wall 20 could be installed at one end of the roll, and a core plug 10 without a central portion 22 could be installed on the opposite end. In this latter embodiment, a vacuum lift force would be created at the end of the roll where the plug lacking the central portion 22 is installed.

With reference to Figs. I and 2, the outer wall 12 may consist of any suitable diameter according to specific inside diameter of the core, or as needed for other special requirements. In one embodiment, the outside diameter of the outer wall 12 will be fractionally greater than three inches to fit tightly inside a typical three inch inside diameter of a core. The three inch core would correspond to a similar three inch diameter of a mandrel or spindle upon which a roll of newsprint is typically mounted. The inner hub 14 may also be constructed of any suitable inside diameter.

The core plug 10 must be sufficiently strong between the inner hub 14 and the outer wall 12 to enable the roll to be supported through the hub. For this reason, a plurality of vanes 18 are disposed between the outer wall 12 and the inner hub 14.

To further enhance the strength between the inner hub 14 and the outer wall 12, the middle strengthening ring 16 is integrally formed between each of the vanes 18. The inner strengthening ring increases the axial strength and dramatically increases the radial strength of the core plug between the inner hub 14 and the outer wall 12. By including the middle strengthening ring 16, the radial strength of the core plug approximately doubles. The outer wall 12, the vanes 18, the inner hub 14, and the strengthening ring 16 combine to form a structural support matrix for providing radial support to a roll when supported through the hub.

Figure 4:
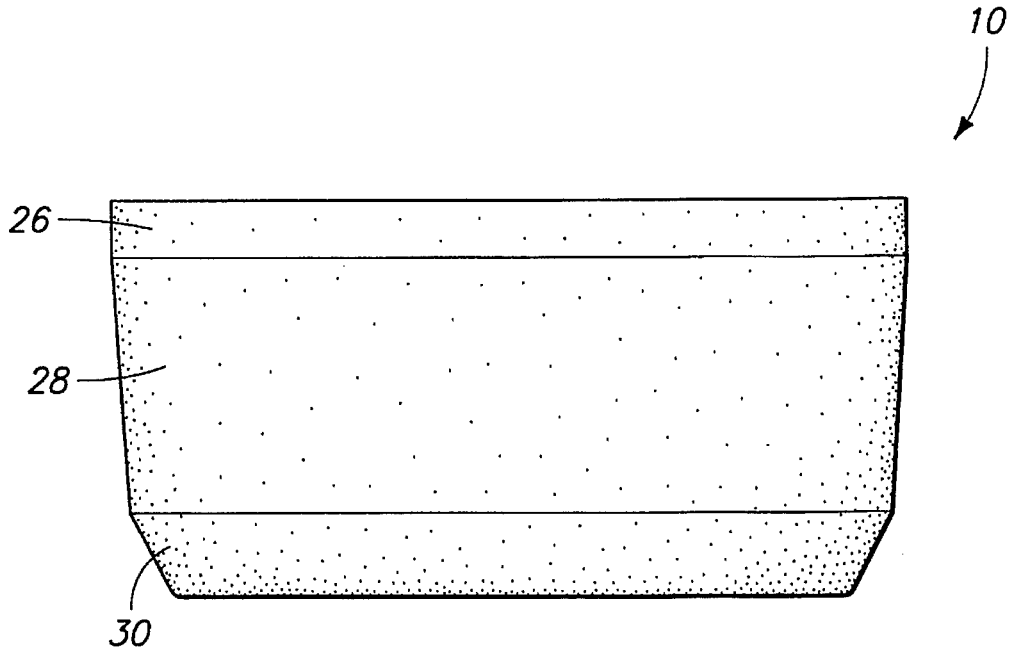
FIG. 4 is a side elevation view of the core plug apparatus of FIG. 1.
Figure 5:
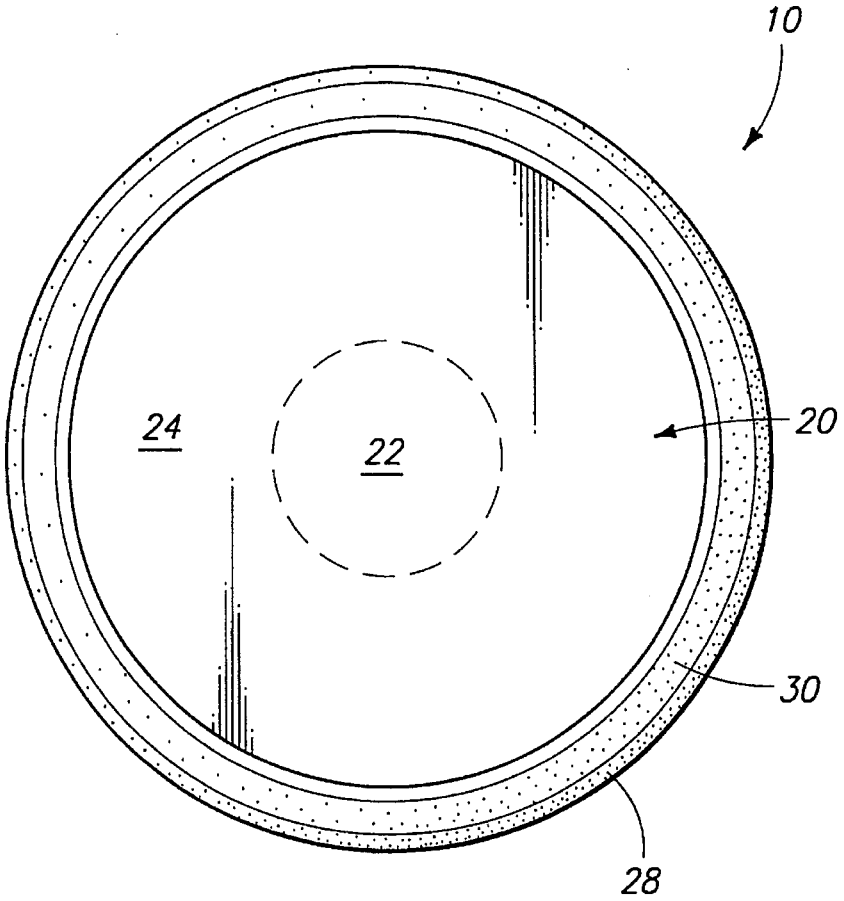
FIG. 5 is a bottom view of the core plug apparatus of FIG. 1.
Figure 6:
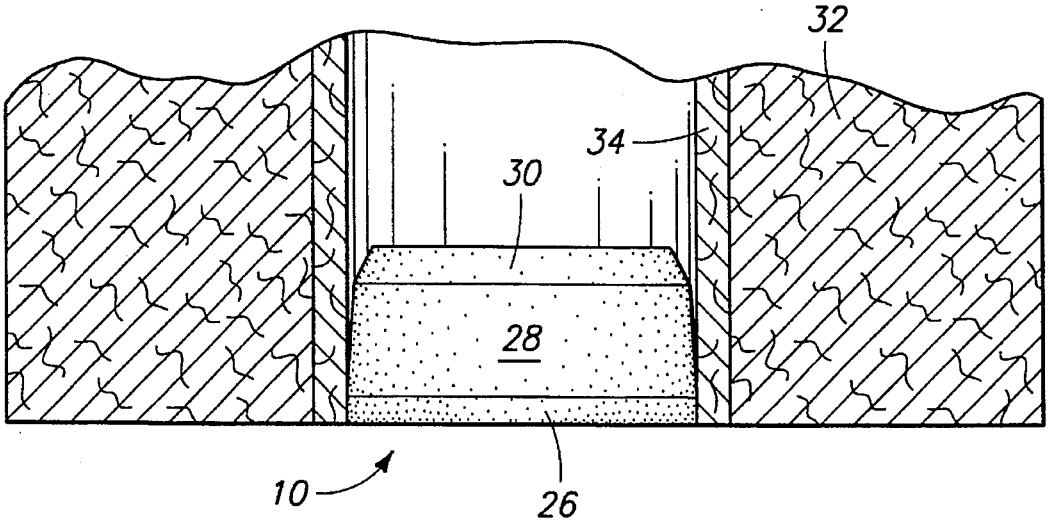
FIG. 6 is a side elevation view, partly in section, of the core plug apparatus of FIG. 1 installed into a roll of material.

With reference to FIGS. 1, 4, and 5, the outer wall 12 of the core plug 10 consists of three sections: a distal cylindrical section 26, a middle sloping section 28, and a proximal frustoconical section 30. The frustoconical section 30 allows for easy initial insertion of the core plug 10 into a core 34 (FIG. 6). The middle sloping section 28 increases in diameter from the proximal end of the core plug to the distal end. The sloping section creates increased friction between the core plug and the core as the core plug is inserted into the core of the roll of material.

The bottom of the distal cylindrical section 26 preferably remains substantially flush with the distal end of the roll of material after the plug 10 has been inserted. The cylindrical section 26 prevents the core plug 10 from being inserted substantially beyond the end of the core for a given insertion force. The plug should preferably be inserted no more than approximately one-fourth of an inch beyond the end of the roll because of the difficulty in removing the core plug thereafter.

In one embodiment, the distal cylindrical section, the middle sloping section, and the proximal frustoconical section have textured or roughed surfaces to increase frictional forces between the core plug and the core. The distal cylindrical section has a larger diameter than the inside diameter of the core to create an interference fit between the core and the distal cylindrical section, thereby restricting relative movement therebetween.

FIG. 6 shows the core plug 10 in an installed position inside a cardboard core 34 around which paper 32 is wrapped. Although the distal cylindrical portion 26 is shown to be flush with the bottom of both the core 34 and the paper 32, it is possible to insert the core plug 10 such that the bottom surface of the distal cylindrical portion extends slightly inward of the outside surface of the core 34.

Using one method of installing a core plug 10 into a core of a paper roll, it has been found that generally 150 to 175 pounds of force are required to install the core plug. In comparison, a vacuum lift force applied to an end of the roll sufficient to lift a typical roll of paper, such as roll of paper for newsprint, will generate approximately 56 pounds of atmospheric pressure. As such, the vacuum force used to lift a large paper roll would not generate enough force to pull the core plug all the way through the core, thus breaking the vacuum seal.

As shown in FIGS. 4–6, the distal cylindrical portion 26, the middle sloping section 28 and the proximal frustoconical section 30 are shown to have rugged or roughed surfaces, which enhances the frictional forces between the core plug 10 and the inside wall of the core 34.

In a preferred embodiment, the core plug is made of polypropylene plastic. Polypropylene plastic is a preferred material because it is strong, lightweight, suitable for creating the friction-resistant abrasive surfaces of portions 26, 28, and 30, relatively inexpensive, and it is not susceptible to water damage.

In operation, a core plug 10 is inserted into a core 34 around which material 32, such as paper, is wrapped. The core plugs may be inserted into the ends of the core 34 after the material has initially been wrapped around the core, just after being removed from the spindles.

When it is desired to move the roll of material including core plugs 10 inserted into each end, a lifting device having a rod may be extended into the inside area of the inner hub 14 with sufficient force to rupture the central portion 22 of the vacuum seal wall 20. This will enable the lift device to lift and transport the roll of paper 32 by transmitting a radial force through the inner hub 14, the radially extending vanes 18, and the outer wall 12 of the core plug 10. Such a lift device could be inserted through one or both core plugs installed inside the core.

Alternatively, the roll of material, including core plugs 10 installed inside both ends of the core 34, may be moved by means of a vacuum device attached to a fork lift truck to lift and transport the roll. In this situation, one of the core plugs 10 must have its entire seal wall 20 intact to create an effective seal so a vacuum force can be generated on the opposite side of the roll.

When it is desired to mount the roll of paper upon a dispensing device (e.g., a reel press), the mandrels or spindles of the dispensing device can also be inserted within the area inside the inner hub 14. An insertion force of a magnitude sufficient to fracture the central portion 22 of the vacuum seal wall 20 must be utilized. The relatively thin central portion 22 will become displaced and allow the mandrel to pass through it before a great enough force is generated that would otherwise force the core plug further into the core. Alternatively, the core plugs 10 can be removed from the core 34 to mount the roll on a dispensing device.

With the central wall removed, if it is desirable to remove the core plug 10 at any time, a core plug removal tool can be inserted through the inner hub 14 to pull out the core.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A core plug apparatus for insertion into a core which is hollow and which has an inner wall surface, comprising:

an outer wall having an outer surface dimensioned for insertion into the core, wherein the outer surface comprises:

a proximal frustoconical section at one axial end, the frustoconical section having a maximum diameter;

a sloping middle section substantially longer in an axial direction than the frustoconical section but sloping radially outward at a smaller rate than the frustoconical section from the maximum diameter to a second maximum diameter; and a distal cylindrical section at the other axial end and connected to the sloping section and having a diameter substantially equal to the second maximum diameter;

an inner hub; and a hollow structural support matrix which is connected to and extends radially outward from the inner hub and which is also connected to the outer wall, and comprising:

a plurality of vanes extending radially between and connecting the inner hub and the outer wall;

a middle ring between the inner hub and the outer wall, the middle ring interconnecting the plurality of vanes; and a solid vacuum seal wall extending in a direction transverse to the axis and positioned adjacent and completely sealing the one axial end.

2. A core plug apparatus according to claim 1 wherein the distal cylindrical section has a textured surface.

3. A core plug apparatus according to claim 1 in which the solid vacuum seal wall is comprised of a central portion and an outer portion, wherein the central portion has a wall thickness less than the wall thickness of the outer portion.

* * * * *